United States Patent [19]

Schroeder

[11] 4,142,390

[45] Mar. 6, 1979

[54] DOUBLE SAFETY LATCH FOR TRAILER DOORS

[76] Inventor: Vernon E. Schroeder, 12910 Tall Forest, Cypress, Tex. 77429

[21] Appl. No.: 770,645

[22] Filed: Feb. 22, 1977

[51] Int. Cl.[2] ..... E05B 9/04

[52] U.S. Cl. ..... 70/371; 70/427

[58] Field of Search ..... 70/371, 423, 427, DIG. 63; 292/40, 66, 153

[56] References Cited

U.S. PATENT DOCUMENTS

| | | | |
|---|---|---|---|
| 1,339,075 | 5/1920 | Toelle | 70/371 |
| 1,917,973 | 7/1933 | Hughes | 70/427 |
| 1,919,647 | 7/1933 | Belknap | 70/1.5 |
| 3,477,261 | 11/1969 | Siana | 70/427 |
| 3,871,284 | 3/1975 | Krise | 70/371 |

*Primary Examiner*—Robert L. Wolfe
*Attorney, Agent, or Firm*—Jack W. Hayden

[57] ABSTRACT

A double safety latch includes a housing with first and second lock means carried thereby. The second lock means is mounted in axial alignment behind the first lock means in the housing with restraining means engaging the second lock means to restrain actuation thereof. Closure or blocking means are associated with the first lock means for blocking access to the second lock means and the restraining means. Actuating means is provided to engage and remove the blocking means from the first lock means for then accommodating access of the actuating means to the restraining means to disengage the restraining means from said second lock means to enable said actuating means to unlock the second lock means.

2 Claims, 8 Drawing Figures

DOUBLE SAFETY LATCH FOR TRAILER DOORS

SUMMARY OF THE INVENTION

Most tractor trailers having doors on the rear end thereof are provided with a latch which may be secured by an ordinary lock. When the tractor trailer is stopped, access may be readily gained thereto by shearing the lock. Quite often, access to the tractor trailer is gained by shearing the lock even when it is stopped at a red light for just a few seconds and valuables removed from the tractor trailer without the knowledge of the driver.

It is therefore desirable to provide a safety latch for the doors of a tractor trailer which blocks opening of the trailer doors and access to the trailer unless a special implement is provided for actuating the safety lock.

Yet a further object of the present invention is to provide a double locking arrangement wherein a pair of locking mechanisms are employed, which locking mechanisms are axially aligned and one of which blocks access to the other locking mechanism so that the one lock mechanism must be first actuated before access can be gained to the second lock mechanism.

Yet a further object of the present invention is to provide a double locking arrangement for the trailer doors of a tractor trailer wherein a pair of locking mechanisms are employed, one of which locking mechanisms blocks access to the other locking mechanism so that the one lock mechanism must be first actuated before access can be gained to the second lock mechanism and wherein the second lock mechanism is normally restrained against actuation, which restraining means can be disengaged from the second locking mechanism only after the first lock has been actuated so that the second lock mechanism may then be actuated to permit access to the tractor trailer.

Other objects and advantages of the present invention will become readily apparent from a consideration of the following drawings and description.

BRIEF DESCRIPTION OF THE PREFERRED EMBODIMENTS

Figure 1:
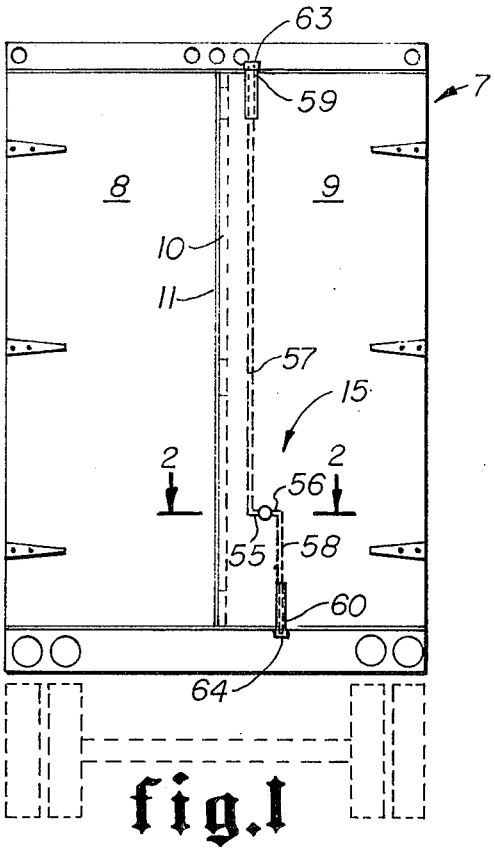
FIG. 1 is a rear elevational view of the doors of a tractor trailer illustrating the present invention positioned thereon.
Figure 4:
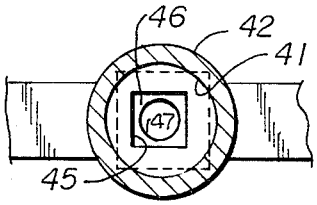
FIG. 4 is a sectional view on the line 4—4 of FIG. 2.
Figure 5:
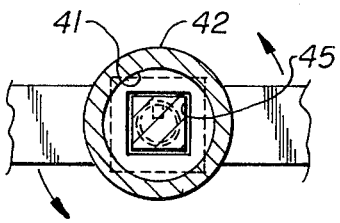
FIG. 5 is a sectional view on the line 5—5 of FIG. 3.

Attention is first directed to FIG. 1 of the drawings wherein a tractor trailer is illustrated generally by the numeral 7 and is shown as having hinged doors 8 and 9 on the rear end thereof which may be swung open for loading and unloading of the tractor trailer. One of the doors, such as the door 8 will have a portion 10 projecting from the vertical end edge 11, which portion 10 is normally recessed relative to the end edge surface of the door 8 so that when the door 9 is closed, the edge 12 of the door 9 will overlap the projecting recessed portion 10 of the door 8 so that access may not be gained to the interior of the trailer van until the door 9 has been opened thereby permitting door 8 to also swing open.

The present invention will be described in relation to its use with a tractor trailer door, although it may be used anywhere a double latch is desired.

Figure 2:
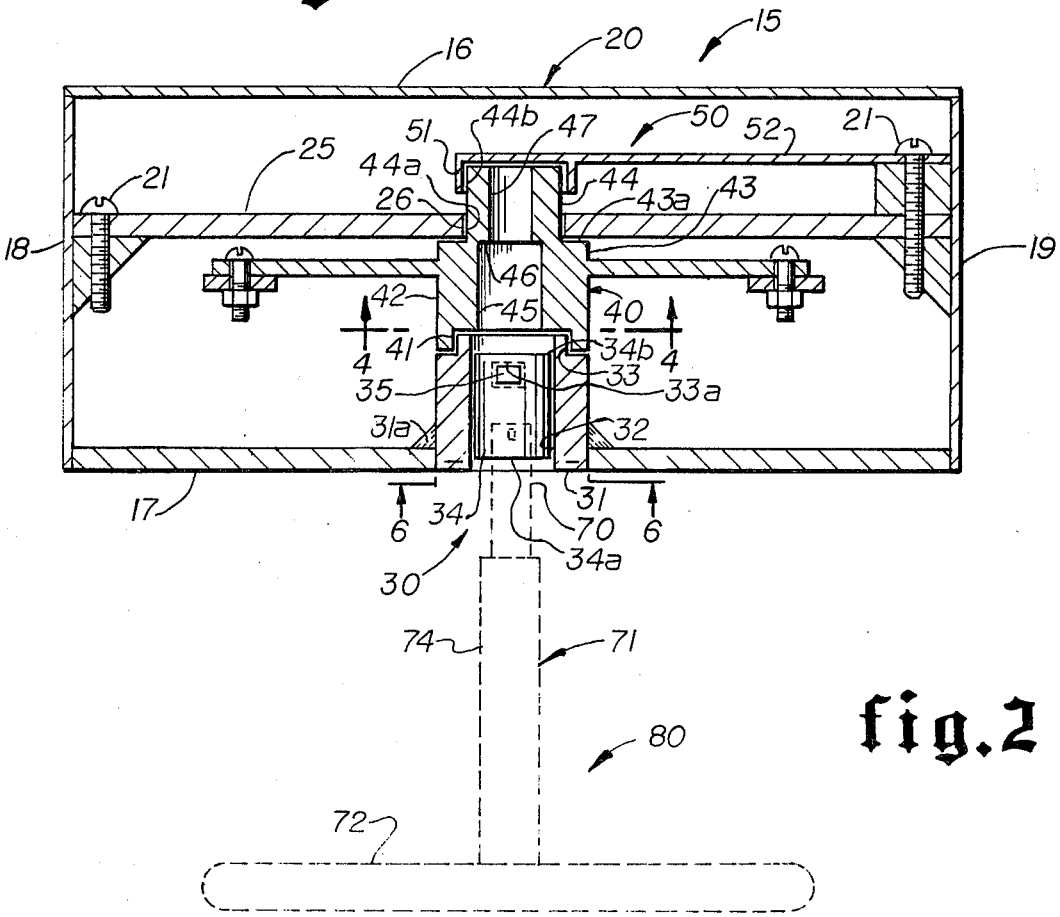
FIG. 2 is an enlarged sectional view on the line 2—2 of FIG. 1.

The present invention is referred to generally at 15 in FIG. 1 and is shown as being mounted in the door 9. It can be appreciated that the overlapping portion 10 could as easily be provided on the door 9 and the present invention mounted in the door 8. In FIG. 2 the present invention is again shown in enlarged detail and is represented generally at 15. It includes a housing referred to generally at 20 having a back wall 16 and a front wall 17 spaced therefrom which are connected by side walls 18 and 19 in any suitable manner such as by welding or the like. An intermediate wall referred to generally at 25 is provided in the housing between the back wall 16 and front wall 17 and is also connected to the side walls 18 and 19 by any suitable means such as the screws 21 as shown in the drawings.

A first lock means is carried by the housing 20, such first lock means being referred to generally at 30 and is shown as being secured to the front wall 17 by suitable means such as the weld 31. Second lock means referred to generally at 40 supported on the intermediate panel or wall 25 in axial alignment with the first lock means 30 as shown in FIG. 2 of the drawings.

Restraining means are referred to generally at 50 are provided for engaging the second lock means 40 to prevent actuation thereof until such restraining means 50 has been disengaged from the second lock means.

The first lock means includes a first member 31 secured to the front wall 17 and having a longitudinal passage 32 extending therethrough. It will be noted that the first member 31 projects inwardly from the wall 17 towards the intermediate panel 25 and is provided with a circumferential surface 33 for fitting within the counterbore 41 formed in the second lock means 40.

A lateral recess **33*a* is provided in the first member 31 and communicates with the longitudinal passage 32** as shown.

Figure 8:
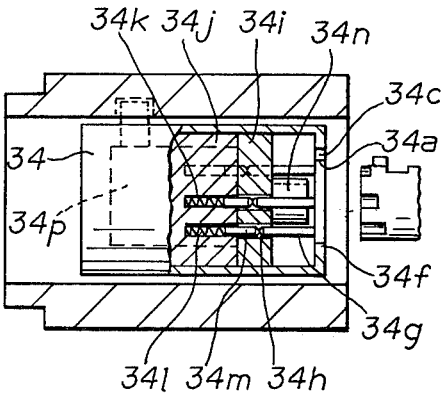
FIG. 8 is a sectional view on the line 8—8 of FIG. 6.

A closure member 34 fits snugly within the longitudinal passage 32 as shown and is provided with a retractable pin 35 for fitting within the lateral recess **33*a* to secure the closure member 34 in position with the first member 31 when the pin 35 is in the extended position as shown in FIG. 2 of the drawings. The closure member 34 is a cylindrical member having the opening 34*a* therein and closed end 34*b*. The opening 34*a* provides an annular shoulder 34*f* which abuts a plurality of circumferentially spaced pins 34*g* carried in holes 34*h* arranged circumferentially in ring 34*i*. Ring 34*i* includes a longitudinal stem 34*p* which rotatably supports ring 34*i* in cylindrical portion 34*j*. Also, stem 34*p* is operatively connected to pin 35 in any suitable manner well known in the art so that when 34*p* is rotated, pin 35 may be retracted into 34 or extended into recess 33*a*. Cylindrical portion 34*j* of closure member 34 is provided with a plurality of circumferentially spaced openings 34*k* in which are received springs 341 that abut pins 34*m*. The pins 34*m* abut the pins 34*g* as shown in FIG. 8 and at such time ring 34*i* is held in non rotatable position relative to portion 34*k* of member 34. The shoulder 34*f* also is provided with a slot 34*c* to accommodate pin 70*d* on actuating means 80** as will be described in greater detail.

Figure 7:
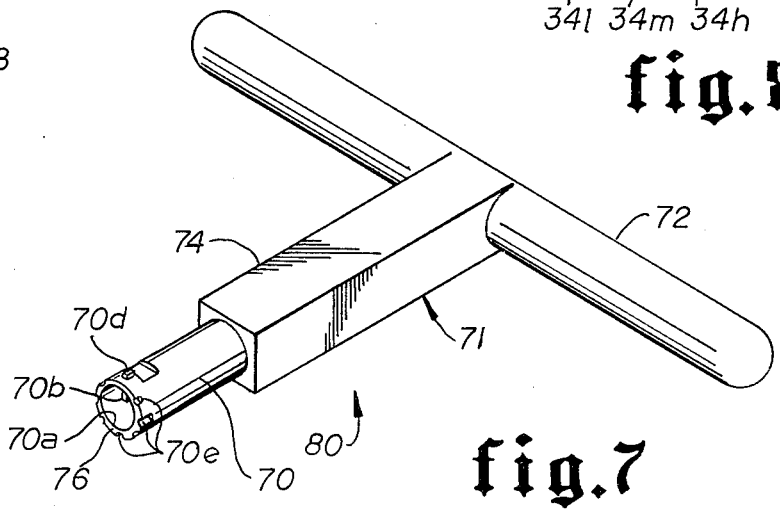
FIG. 7 is a perspective view of the actuating means employed with the invention.

Also, ring 34*i* includes the annular stem or projection 34*n* which has a longitudinal slot 34*o* to receive the projection 70*b* shown in FIG. 7.

It will be noted that there is an annular clearance 34*p* between projection 34*n* and the annular opening 34*a* to receive the end portion 70 of the key or actuating means 80 for removal of closure 34 as will be described. The pin 35 is retractable within portion 34*k* to withdraw the pin 35 from recess 33*a* as will be described.

It will be noted that the second lock means 40 includes a second member 42, the second member 42 having a first portion 43 of a larger width than the portion 44 as shown in the drawings. The portion 43 is provided with a first longitudinal noncircular passage 45 which terminates at the shoulder 46 that is axially aligned with the longitudinal passage 32 in the member 31. The shoulder 46 defines the juncture of the portions 43 and 44 and a passage 47 of a smaller width extends through the portion 44 and is axially aligned with the passage 45 as shown in the drawings.

Also it will be noted that the shoulder 43*a* positions the second member 42 relative to the intermediate panel 25 and such shoulder 43 in cooperation with the panel 25 as well as the annular portion 33 and counterbore 41 serve to position the second member 42 in axial alignment with the first lock means 30 and for axial rotation relative thereto in a manner as will be described. The surface 44*a* of the portion 44 adjacent the opening 26 in the panel 25 is circular to accommodate relative rotation of the member 42 when the second lock means is actuated as will be described. The surface portion 44*b* adjacent the outer extremity of the portion 44 is noncircular and telescopically fits within the noncircular member 51 formed on the end of the engaging means 50. The engaging means 50 is in the form of a longitudinally extending spring like member 52 which is secured to the housing 20 by the screw 21 as shown and normally engages the portion 44 of the second lock means 40 to prevent rotation thereof.

The actuating means 80 includes shaft means 71 and handle 72. The shaft means 71 includes a noncircular portion 74 extending from the handle 72 to the annular end portion 70 as shown in FIG. 7. The annular end portion 70 is a hollow cylinder 70*a* extending from the juncture of noncircular portion 74 and annular end portion 70 to the outer end of shaft means 71. The key or projection 70*b* extending longitudinally within the cylinder 70*a* and the hollow cylinder 70*a* is of a size to telescopically receive axial projection 34*n* when end portion 70 is inserted in the opening 34*a* of closure member 34. The key 70*b* on annular end portion 70 thus is engaged in keyway or slot 34*o* of projection 34*n* and projection 70*d* and passes through slot 34*c* in shoulder 34*f*. A plurality of circumferentially spaced semicircular recesses 70*e* of varying length is provided on the outer circumference of end portion 70 at the end thereof as shown in FIG. 7. The length of the recesses 70*e* conforms with the length of the pin 34*m* to be received in its respective recess 70*e* so that when hollow cylinder 70*a* is inserted in opening 34*a* and surrounds projection 34*n*, the springs 34-1 are depressed so that the ends of pins 34*m* and 34*g* are positioned adjacent the abutting surfaces of ring 34*i* and cylindrical portion 34*j*. When pins 34*m* are in such position ring 34*i* may be rotated since 70*b* engages in slot 34*o*. When ring 34*i* is rotated by rotation of 70*a* in the direction of the arrows of FIG. 7, stem 34*p* is also rotated and it moves or retracts the pin 35 into 34. The closure member 34 is engaged on the end of 70 of actuating means 80 by reason of projection 70*d* being misaligned with slot 34*c* after handle 72 has rotated ring 34*i*, so that 70*d* abuts against the inside of shoulder 39*f* and causes 34 to be withdrawn from the first member 31 when the actuating means 80 are withdrawn.

Figure 3:
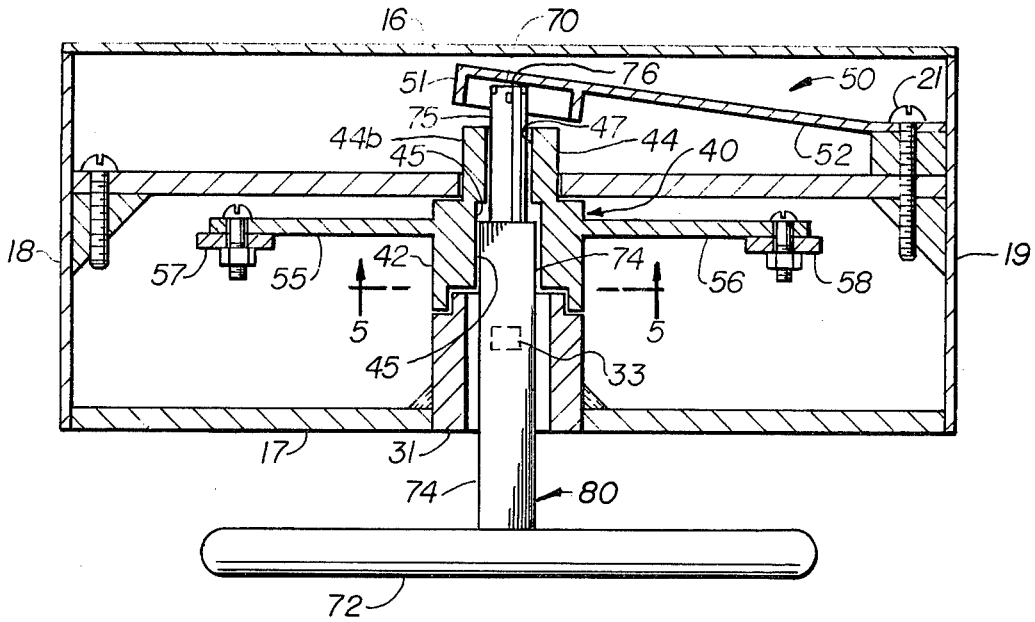
FIG. 3 is an enlarged sectional view similar to FIG. 2 but illustrates actuating means for disengaging the restraining means from the second lock means so that the second lock means may be actuated after the first lock means has been actuated.
Figure 6:
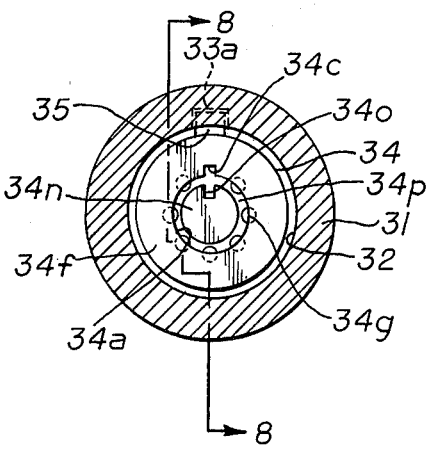
FIG. 6 is a sectional view on the line 6—6 of FIG. 2.

After this has occurred, the noncircular portion 74 of the shaft means 71 and the annular portion 70 projecting from the noncircular portion 74 may be extended into and through the first noncircular longitudinal passage 45 in member 42 and into the second or circular passage 47 of the member 42 as shown in FIG. 3 of the drawings. When this occurs the end 76 of annular end portion 70 on the shaft means 71 engages the restraining means 50 so that the spring like member 52 is moved away from the portion 44 to disengage the member 51 from the portion 44 as shown in FIG. 3 of the drawings.

When this occurs, the handle 72 may be grasped and rotation imparted to the member 42 by engagement of the noncircular portion 74 with the noncircular longitudinal passage 45 of the second lock means 40. Projections 55 and 56 extend radially from the member 42 and are pivotally connected by any suitable means such as that illustrated in FIGS. 2 and 3 of the drawings to the actuating links 57 and 58. The ends 59 and 60 of the actuating links 57 and 58 respectively fit within receptacles 63 and 64 adjacent the top and the bottom of the door 9 as illustrated schematically in FIG. 1 of the drawings. Thus when the member 42 is rotated by means 80, the ends 59 and 60 are withdrawn from the pockets 63 and 64 so that the door 9 may then be swung open. Thereafter the door 8 may be opened for access to the tractor trailer.

From the foregoing description it can be seen that the first lock means 30 is provided with a closure means 34 which normally blocks access to the second lock means 40, and that the second lock means is provided with restraining means which prevents actuation thereof except by the actuating means 80 which is shaped and configured to engage with the means 42 and to disengage the restraining means 50 from the second lock means 42 only after the closure means 34 has been removed from the first lock means 30. Thus, to actuate the present invention the first lock means must be first actuated and then in addition the restraining means 50 must be disengaged from the second lock means 40 which only then permits the second lock means 40 to be rotated to move the links 57 and 58 for unlocking the second lock means. Thus, the present invention prevents ready access to the tractor trailer and at any event prevents access unless the actuating means 80 of a particular configuration is employed for removing the closure 34 from the first lock means 30 and for engagement with the noncircular passage 45 of the member 42, as well as projecting therethrough to disengage the restraining means 50 from the second lock means 40 whereupon the second lock means then may be actuated.

The foregoing disclosure and description of the invention are illustrative and explanatory thereof, and various changes in the size, shape, and materials as well as in the details of the illustrated construction may be made without departing from the spirit of the invention.

What is claimed is:

1. A safety latch for a trailer door comprising:

a. a housing;

b. said housing having spaced front and back walls connected by side walls with an intermediate panel connected to said side walls and extending substantially parallel between said front and back walls;

c. a first member secured to said front wall and having a longitudinal passage therethrough;

d. said first member having lateral recesses communicating with the longitudinal passage;

e. a closure member for fitting in the longitudinal passage;

f. said closure member having retractable pins for fitting within the lateral recess to secure said closure member in said first member;

g. actuating means connected with said pins and operable to retract said pins from the recesses whereby said closure member may be withdrawn from said first member;

h. a second member rotatably supported on said panel in axial alignment with said first member;

i. said second member having a first longitudinal noncircular passage having a smaller width than the longitudinal passage in said first member and axially aligned with the longitudinal passage in said first member;

j. said second member having a second longitudinal passage axially aligned with and smaller in width than the first noncircular passage;

k. restraining means engaging said second member to restrain it against rotation;

l. shaft means;

m. engaging means on said shaft means engageable with said actuating means to retract said pins for removal of said closure member from the longitudinal passage in said first member and expose the first and second passages in said second member;

n. a noncircular portion on said shaft means for fitting in the longitudinal noncircular passage in said second member; and o. said shaft means having an end surface to abut and disengage said restraining means from said second member when said shaft means is inserted in said first and second members whereby said shaft means and second member may be rotated.

2. The invention of claim 1 including:

a. arms projecting radially from said second member;

b. rod means pivotally secured to each of said arms;

c. retaining means on the trailer telescopically receiving the ends of each of said rod means; and d. said arms rotatable with second member to retract said rod means from said retaining means.

* * * * *